US005347668A

United States Patent [19]

Manning

[11] Patent Number: 5,347,668

[45] Date of Patent: Sep. 20, 1994

[54] THERAPEUTIC HEADREST DEVICE

[76] Inventor: Duane B. Manning, 3050 N. 150 East, North Ogden, Utah 84414

[21] Appl. No.: 131,122

[22] Filed: Oct. 4, 1993

[51] Int. Cl.[5] ..... A47C 16/00; A61G 7/06

[52] U.S. Cl. ..... 5/622; 5/638; 5/640; 5/643; 5/644

[58] Field of Search ..... 5/622, 638, 640, 643, 5/644, 637, 621, 623, 624, 625, 628, 636, 411; 128/869; 606/242

[56] References Cited

U.S. PATENT DOCUMENTS

| | | | |
|---|---|---|---|
| 795,108 | 7/1905 | Doellinger | 5/644 |
| 3,795,021 | 3/1974 | Moniot | 5/640 X |
| 4,333,638 | 6/1982 | Gillotti | 5/622 X |
| 4,346,298 | 8/1982 | Dixit | 5/622 |
| 4,528,705 | 7/1985 | Greenwalt | 5/644 |
| 4,757,983 | 7/1988 | Ray et al. | 5/640 X |
| 4,840,362 | 7/1989 | Bremer et al. | 5/621 X |
| 5,068,933 | 12/1991 | Sexton | 5/644 |

*Primary Examiner*—Michael F. Trettel

*Attorney, Agent, or Firm*—Thorpe, North & Western

[57] ABSTRACT

A head support device to be used in cooperation with a treatment table for humans such as a chiropractic or therapeutic table. The head support device provides a comfortable support for a patient's head during therapy, wherein the head support device includes a baseplate of polygonal shape having at least four sides, including two opposing, longer sides and opposing top and bottom sides. The bottom side includes an opening that allows airflow to a patient when face-down on the table. The baseplate includes a pair of flanges connected to the opposing longer sides of the baseplate and extending upward from the baseplate within a range of 20 to 90 degrees. Attachment structure coupled to the head support device enables attachment of the head support device to the treatment table. A patient controlled pressure adjustment mechanism is attached to the pillow to permit the patient adjust air pressure to a desired comfort level. A second pillow having a medial hinged section is suspended from the baseplate.

19 Claims, 4 Drawing Sheets

THERAPEUTIC HEADREST DEVICE

BACKGROUND OF INVENTION

1. Field of Invention

This invention relates to a device to be used in cooperation with a massage or chiropractic table, tanning bed, medical treatment table, or other support structure in which a comfortable surface for a patient's head is provided as he/she is undergoing therapy. Specifically, the invention provides a head support apparatus that supports a pillow on which the patient's head can rest in face-down orientation while still permitting normal breathing.

2. Prior Art

During therapy it is necessary that the patient be in a prone position on a massage table, thereby allowing the medical attendant to work on him with maximum efficiency. The patient usually lays on the massage table in either a face-down or face-up position depending on the work being done by the medical attendant. Early tables included a facial opening within a top surface that would allow the patient to lay on the table in a face-down position with his face in the opening. The location of the opening within the perimeter of the table often limited the medical assistant from complete access to the patient's head and neck.

Discomfort to the patient on this earlier table and the lack of accessibility of the patient's head and neck to the medical attendant led to the use of an attachable head support device at the table end. The head support device protrudes from the top end of the table. This protruding device is a planar plate member that supports a pillow and positions the pillow at approximately the same lateral plane as the table.

This prior art headrest included a plate with attachment means which was coupled to the massage table. Generally a pillow rests freely and unattached on the plate and can be changed at any time. A problem that exists with the freely resting pillow support is that the pillow lacks lateral stability. As the patient is moving the pillow may slide off the base support and cause the patient's head to contact the hard plate that supports the pillow. Despite this risk and inconvenience, such freely moveable pillows continue to be used to facilitate rapid switching of pillows for each new patient.

Another reason this freely resting pillow is still being used is that the height of the pillows can be changed by simply stacking more pillows on top of each other. The stacked pillows provide a very comfortable surface for the head and effectively raise or lower the height of the head. It is important that the head support pillow be versatile, in that the height is adjustable due to the different needs of each patient. This height shift is necessary, for example, when a patient is shifted from the face down position to a face up position, wherein additional height is needed under the head. The conventional practice of stacking pillows not only provides an insecure head support, but also interrupts the massage or therapeutic process because the patient must usually sit up in order to allow the medical attendant to change the height of the pillow.

The support pillows are generally stacked on a head support base which is usually attached to the table by using two rods that protrude from the head support base and slide into openings in the therapeutic table. These sliding rods allow the head support to be adjusted in relation to the height of the patient. In order for the attachment means to function properly, the distance between the rods must correspond to the distance between each hole in the table. Due to the lack of a universally accepted size of head support rods, there is sometimes an inconsistency between the attachment means of the head support base and the attachment means of the therapeutic table, therefore the medical assistant is limited to the type of head support he can use by the type of therapeutic table he uses.

OBJECTS AND SUMMARY OF THE INVENTION

It is an object of the invention, therefore, to provide a new head support device that provides lateral support to a pillow that is resting on the planar plate of the head support device.

It is a further object to provide an apparatus that allows the patient airflow as he is in a face-down position on the pillow.

It is a further object to provide an apparatus to allow the medical attendant to adjust pillow height with minimal movement of the patient.

It is a further object to provide adjustable attachment means on the head support device, thereby allowing the head support device to be used with most types of tables.

These and other objects of the present invention are realized in a head support device to be used in cooperation with a chiropractic, therapeutic, tanning or similar form of support table. This head support device provides a comfortable support for a patient's head during therapy. Part of the head support device is formed by a baseplate of polygonal shape having four sides, including two opposing, longer sides and opposing top and bottom sides. The bottom side includes an opening that allows airflow to the patient when face-down. The head support device contains a pair of lateral flanges connected to the opposing, longer sides of the baseplate. These lateral flanges extend upward from the baseplate within a range of 20 to 90 degrees. The head support device also contains attachment means for connecting the head support device to the therapeutic table. The attachment means can be adjusted in relation to the table to provide extension positioning, as well as side-to-side positioning. Inflation adjustment means are also provided to allow either the therapist or the patient to modify inflation levels of the pillow to thereby soften facial contact or provide height adjustment. A second height-adjustment pillow is suspended from the base plate to enable rapid and comfortable placement over the inflatable pillow for further elevation.

Other objects and features of the present invention will be apparent to those skilled in the art, based on the following detailed description, taken in combination with the accompanying drawings.

DETAILED DESCRIPTION OF THE INVENTION

Figure 1:
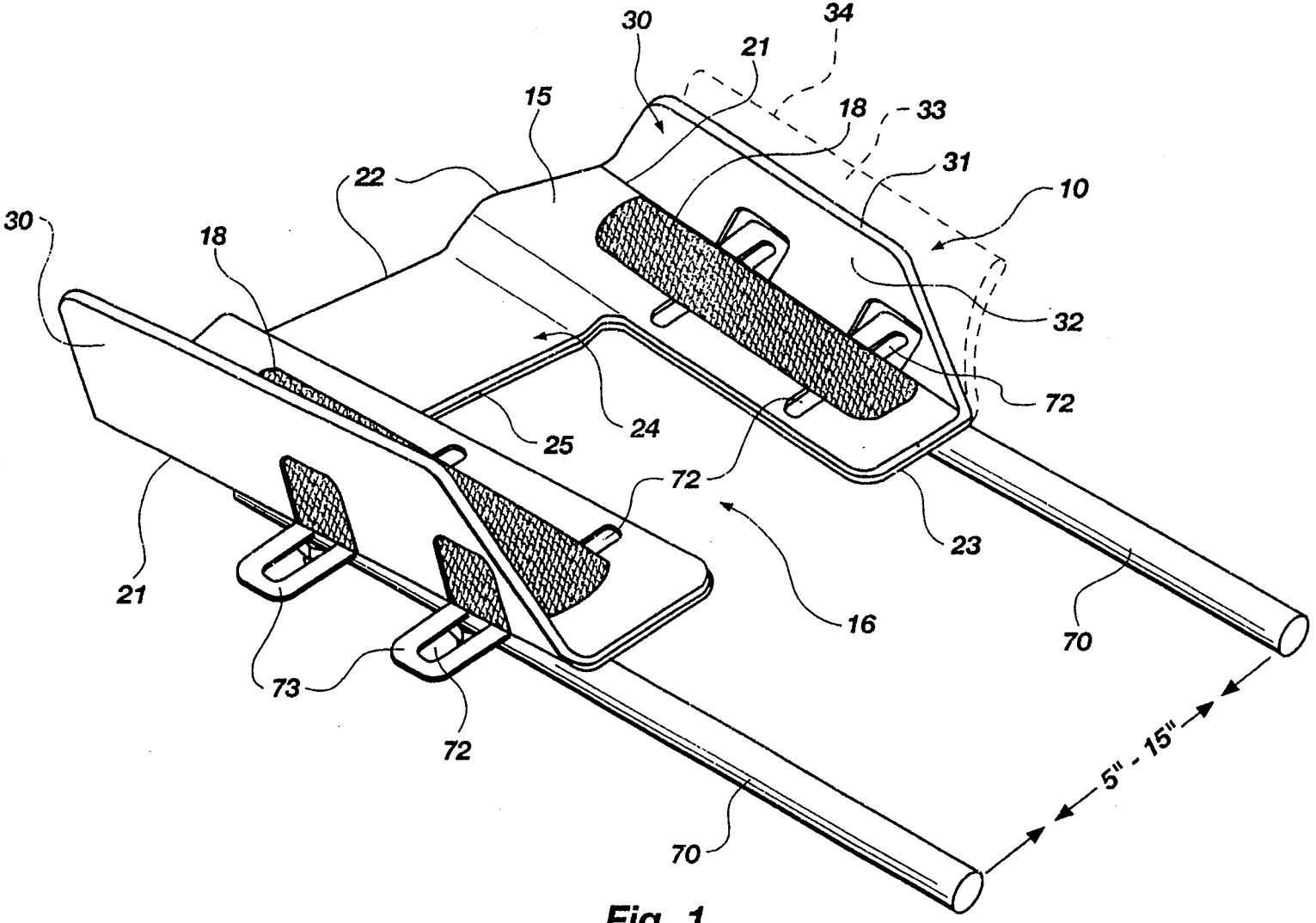
FIG. 1 shows a perspective, elevated view of a headrest support device constructed in accordance with the present invention.

Referring now to the drawings:

FIG. 1 illustrates a head support device 10 to be used in cooperation with a chiropractic, massage, medical, tanning, or other form of therapeutic table. The purpose of the head support device is to provide a comfortable support for a patient's head during therapy. The head support device comprises a baseplate 15 of polygonal shape having four sides, including two opposing, longer sides 21 and opposing top 22 and bottom 23 sides. The base plate may include a channel indentation 24 which forms a recession for the patient's forehead when thinner pillows are used. Otherwise, a flat base plate may be equally acceptable particularly with the use of pillows having greater thickness and cushion support. The illustrated indentation is approximately one-half inch.

The bottom side 23 includes an opening 16 that allows airflow to patient when face-down on a therapeutic table. It should be noted that although the opening 16 is depicted in a rectangular shape, other configurations may be equally useful. For example, a half elliptical opening could be used which would more nearly conform to the shape of the patient's face. It is to be understood, therefore, that the representation of a particular geometry for the base plate opening is not intended to be limiting. Similarly, the baseplate comprises a trapezoidal shape with the top side being longer in length than the bottom side. This likewise is merely one example of desirable structure.

The head support device also contains a pair of flanges 30 connected to the opposing longer sides 21 of the baseplate. The flanges extend upward from the baseplate within a range of twenty to ninety degrees. The preferred inclination is approximately 45 degrees. This is favored because the flange also serves to block a patient's head from rolling over the edge of the pillow 17. Although this may not be a problem in general medical applications, the use of the present invention as part of massage therapy is designed to produce extreme relaxation. If the patient feels any sense of position insecurity, he will be reluctant to totally relax and will frustrate the work of the therapist. For example, if the patient's head is slightly teetering on the pillow edge, and there is not sense of lateral support, the patient will maintain some muscle tension in his neck to facilitate a quick recovery just in case the head starts to move toward the edge. This defeats the efforts of the therapist, who is trying to get total relaxation so that he can massage the muscles in a relaxed condition.

Furthermore, there is less risk of injury when the flange is inclined, with the face portion directed toward the patient rather than the edge 31. When inclined, any contact tends to be at the flat face 32 of the flange, rather than on the sharper edge 31. When positioned at a more vertical orientation, the edge 31 becomes the point of initial contact with the patient's head, and could cause injury, depending upon the force of the contact.

The actual length of the flanges will depend upon the anticipated inflated height of a pillow 17 which is supported on the base plate 15. Generally, the length should be approximately equal to the pillow when inflated. It should also be noted that the length will be a function of configuration of the flanges. For example, if the flanges are arcuate in convex fashion, rather than planar, the length may need to be slightly longer. Such an arcuate geometry is illustrated in phantom line 33, and offers less risk of adverse contact with the edge 34 of the flange.

The flanges 30 also serve to prevent lateral movement of a pillow that rests on the baseplate 15, thereby maintaining the pillow 17 in an appropriate position. Attached to the baseplate 15 are pieces of velcro 18 or other attachment means, to further secure the desired position. The pillow may also be banded to the base plate with straps, however, these tend to cause discomfort to the patient's face. The use of lateral flanges facilitates the use of less rigid attachment means between the pillow and base plate because of the lateral support provided by the flanges.

The pillow 17 also contains an opening 40 that is placed over the opening 16 in the baseplate. The openings in the pillow 40 and in the baseplate 17 provide an air passage to the patient as he is in a face-down position. On the top rim of the opening in the pillow 40 is an indentation 41 that extends toward the center of the opening. The indentation is used to support the forehead in a pocket which tends to cradle the head in greater comfort. This may be formed by a vertical wall 42 within the volume of the pillow which will produce indentation 42 across the pillow.

The opening within the pillow 40 provides a comfortable support for face in a face-down position. The opening allows the nose and mouth to be positioned within the opening. The rim 43 of the opening in the pillow provides support to the cheek bones, the chin and the forehead. The rim 25 of the supporting base plate complements this support to give the patient a sense of security and comfort, without any breathing restriction. When a towel is wrapped around the pillow for sanitary purposes, the opening 16 formed within the surrounding towel can be scented with medications that may be appropriate for patient inhaling.

To further secure the position of the pillow about the chin of the patient, a fastening means such as a snap 29 can be applied near the bottom of the pillow to join the opposing extended 27 and 28. This ensures that the face of the patient will remain cradled within the opening 40. Other fastening means may likewise be used in place of the disclosed snaps.

The present invention is particularly well suited for use with an inflatable pillow. Such a pillow has the ability to expand or contract in accordance with the medical assistant's needs. The present invention includes the use of a pumping circuit which enables the patient to adjust the inflation to his desired level of comfort. Prior use of inflatable pillows required the degree of inflation to be set prior to therapy. If the pillow was highly inflated, it becomes stiff and uncomfortable. Although a patient may prefer less air pressure, there was no convenient mechanism to allow adjustment of this air pressure. Furthermore, the pillow may lose some pressure during therapy. Rather than disturbing a comfortable massage, the patient will typically ignore the uncomfortable pressure loss, instead of raising his head while the pillow is re-inflated.

The present invention includes an air pressure adjustment mechanism that allows the therapist to quickly add or release air from the pillow for specific height adjustment. Similarly, the patient may reach from his inclined position and modify the air pressure without interfering with the activities of the attendant. In this manner, the inflation is set to the exact comfort level by the patient. This involves no need to communicate with the attending medical person or to interrupt the therapy.

The pillow is connected to a pumping mechanism 50 by means of a hollow tube 51, which is fed through a cleft 52 within the baseplate 15 and finally hooked to a valve 53 that allows the pumped air to enter into the pillow. The pumping system utilizes a pressure pump-/release device similar to that applied to blood pressure cuffs. This includes the compressible bulb 55 and the attached detente valve 53 which enables the user to release air from the pillow my merely pressing the button/valve 53 combination. With this attached pumping system, the patient can grasp the bulb in one hand while laying in a relaxed position face down, and either increase or decrease the pillow air pressure. The medical attendant need have no involvement with this operation.

Positioned on the pillow is another valve, a pressure release valve 54. This pressure release valve provides a safety mechanism against over-expansion of the pillow. When the pressure of the air within the pillow is equal or greater than a specific pressure which is preset into the pressure release valve 54, the valve will automatically release air from the pillow. The safety release valve may also allow the medical attendant to release the air from the pillow when desired.

An additional pillow 60 hangs from the head support device by a strap 61. This pillow is preferably of foam rubber composition, but may also be inflated with air. The pillow 60 is used to raise the height of the head support device in one step by stacking the second pillow 60 on the inflatable pillow 17 which is already resting on the head support device. This is generally required when a patient moves from his front to a back position. Generally, the patient's head needs to be raised one to two inches when resting on his back.

Prior art techniques have required the attendant to leave the patient to secure this second pillow, creating a momentary break in the therapy. The present invention places the second pillow in immediate access to the attendant. At the point of need, the attendant merely reaches under the head support device and moves the pillow to the superimposed position as shown by the phantom lines 56.

A further unique feature of the present invention is provided by the slit or groove 57 constructed within the foam insert of the pillow. Although the groove 57 is substantially unnoticeable to the patient, it facilitates sliding the pillow under the patient's head without a need for raising the head any more than the thickness of the pillow. Without the groove 57, the stiffer pillow 60 would be pivoted around the end of the head support device in its flat configuration. If the strap were left in place, the patient's head must be raised a substantial distance to allow the pillow to follow an arched path into the flat position shown in FIG. 2. With the groove, the pillow 60 can be positioned by bending it around the end of the head support device and sliding it into position.

Figure 2:
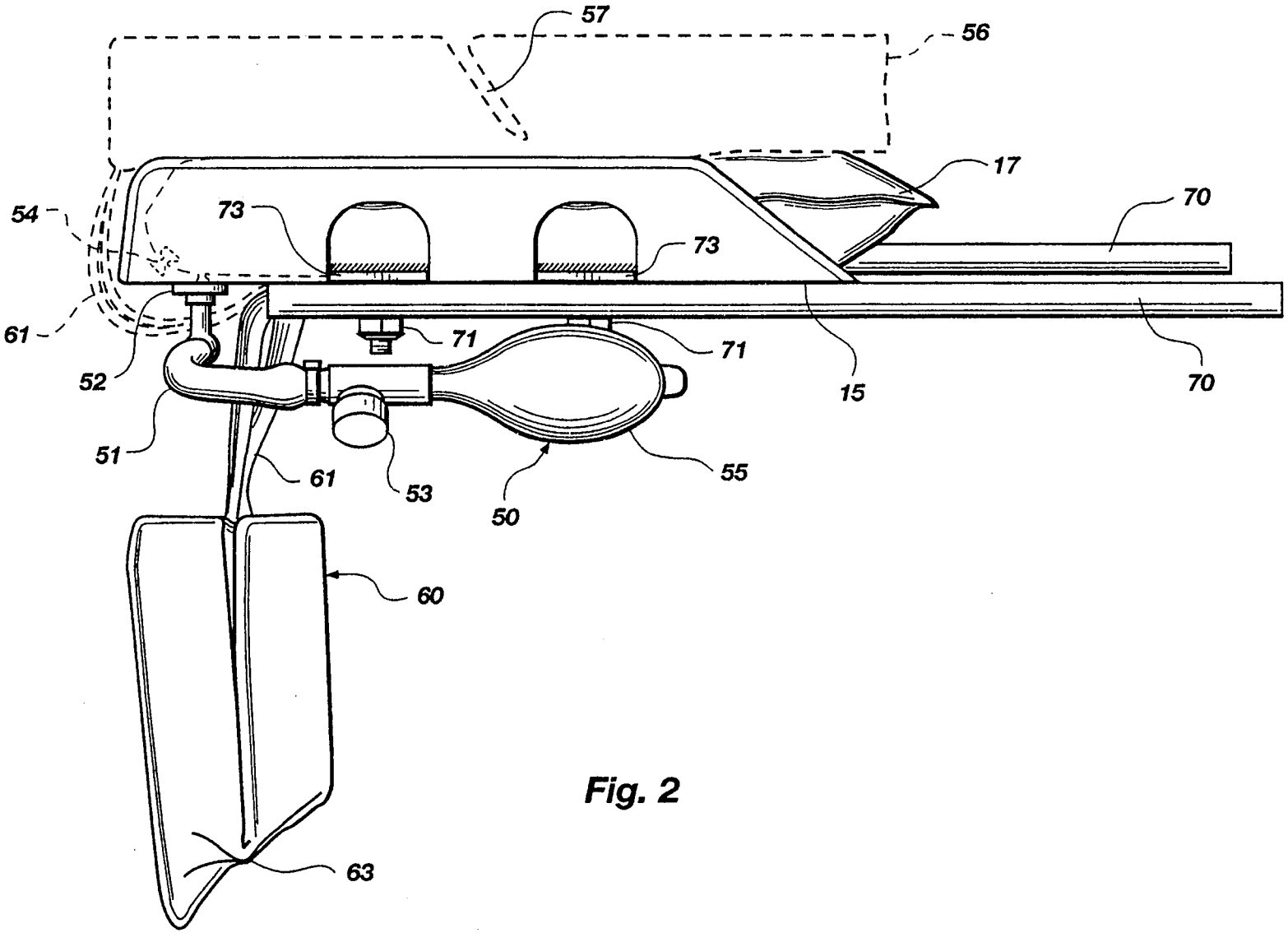
FIG. 2 is a side view of the device shown in FIG. 1, including an inflatable pillow positioned in the support device, with phantom line depiction of a second pillow supported on the inflatable pillow.

This groove 57 also allows the pillow to be folded in half when desired, as illustrated in FIG. 2. This configuration takes less space. The interconnecting structure 63 which joins the two halves of the pillow 60 also acts as a hinge to allow the medical assistant to slide the hanging pillow 60 along the arched path and under the patient's head, thereby minimizing the movement of the patient and effectively raising the height of the patient's head.

The head support device of the present invention may be adapted for attachment to all forms of therapeutic tables. These may include those with bracket or clamp attachment mechanisms, or with the interlocking rod/insert configuration as illustrated. In accordance with the preferred embodiment, protruding from the bottom side 23 of the baseplate are two adjustable rods 70. These rods slide into two holes in the therapeutic table for rigid attachment.

To facilitate use with tables of different configuration, the preferred embodiment of the present device incorporates laterally adjustable rods. Specifically, the distance between the rods can be adjusted by four sliding clamps 71. The length between the rods can be adjusted by loosening the clamps and then sliding the rods to the desired position and re-clamping the rods to the baseplate. The range of the distance between the rods is five inches to fifteen inches. The adjustable rods make the head support device compatible to most of the therapeutic tables in existence.

One means for providing the slidable structure is to form tracks or slots 72 in push-out tabs cut directly into the base plate 15. Where the device is formed of a single construction in which the lateral flanges are bent end sections of a single plate, the openings for the slots, as well as the cuts for the tabs can be accomplished with a single pass of the cutting die. This enables the fabrication of the device with a single piece of metal. The lateral adjustment tabs 73 remain in the plane of the base plate 15, as the flange sections are bend upward to the desired inclination of 45 degrees.

Figure 3:
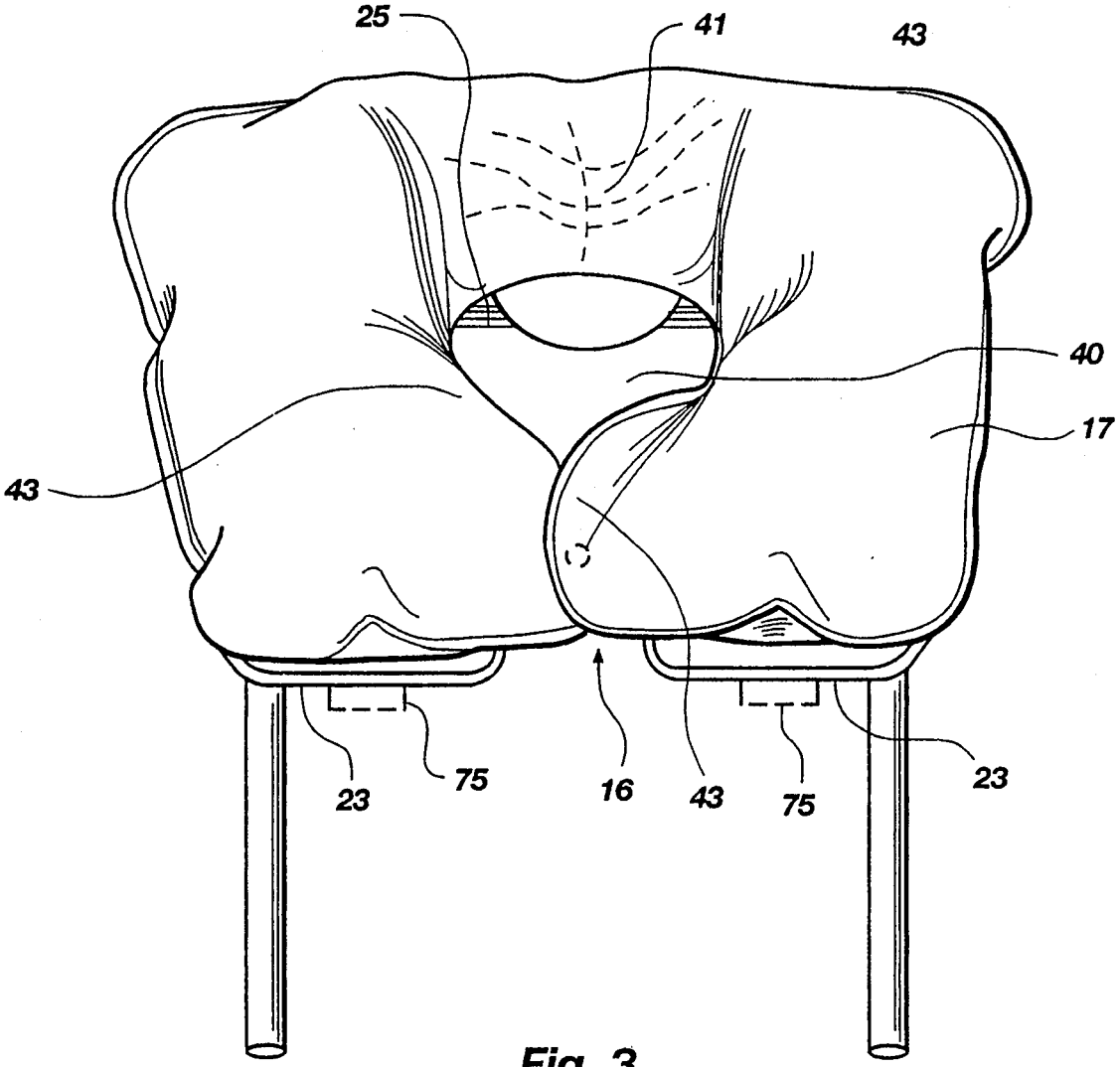
FIG. 3 shows a top, plan view of the device illustrated in FIG. 2.

Alternatively, the rods could be formed with inwardly bent ends as shown in phantom line 80 in FIG. 3. These rods could be rotatably anchored to the base plate so that variable mounting widths 81 could be matched by merely adjusting the degree of rotation of the rods at the base plate, enabling selection of the correct separation distance.

Figure 4:
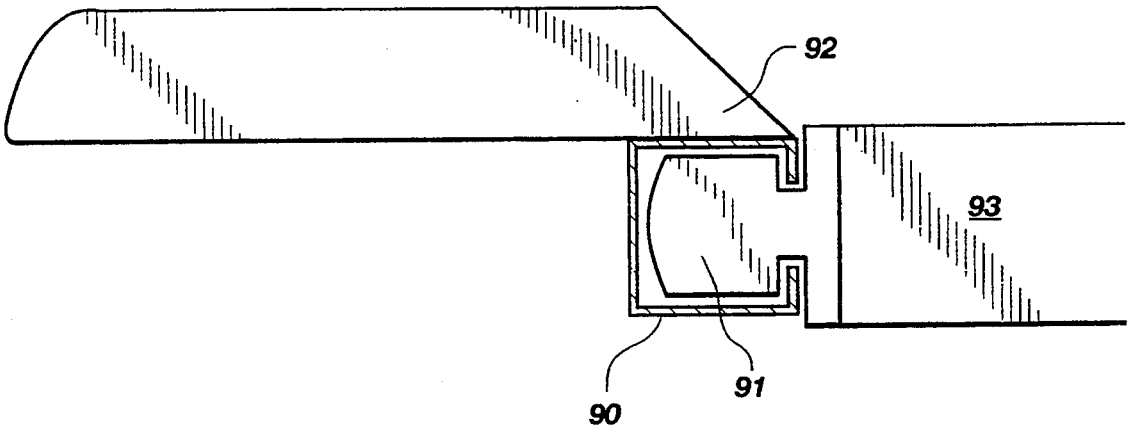
FIG. 4 shows an additional embodiment in side view, graphically illustrating an alternate form of lateral attachment of the base plate on a mounting channel.

An alternate configuration for attachment is shown in FIG. 4. This embodiment enables mounting the support device laterally. A C-channel 90 and channel insert 91 are respectively attached to the joining ends of the support device 92 and table 93. The figure illustrates the C-channel attached to the baseplate at a forward end, with the channel insert being affixed to the end of the table. This configuration enables the headrest to be slidably emplaced from the side of the table, offering an advantage of lateral position adjustments.

It will be apparent to those skilled in the art that other variations of structure can be envisioned with respect to the foregoing disclosure. For example, the attachment means may also comprise two clamps 75 coupled to the bottom side of the baseplate, which can be clamped onto the therapeutic table. Accordingly, it is to be understood that the scope of the present invention is intended to cover equivalent constructions which are comprehended within the following claims.

I claim:

1. A head support device to be used in cooperation with a treatment table for humans such as a chiropractic or therapeutic table, said head support device to provide a comfortable support for a patient's head during therapy, said head support device comprising:

a baseplate of polygonal shape having at least four sides, including two opposing, longer sides and opposing top and bottom sides, said bottom side including an opening that allows airflow to a patient when face-down on the table;

a pair of flanges connected to the opposing longer sides of the baseplate and extending upward from the baseplate within a range of 20 to 90 degrees;

attachment means on said head support device for connecting the head support device to the treatment table.

2. A device as defined in claim 1, wherein the baseplate comprises a trapezoidal shape with the top side being longer in length than the bottom side.

3. A device defined in claim 1, wherein the flanges comprise a rectangular shape with longer sides equal to a length of the longer sides of said baseplate.

4. A device defined in claim 1, wherein the flanges comprise rectangular shape with height of approximately 3 inches.

5. A device as defined in claim 1, further comprising a pillow resting on said baseplate and between said flanges.

6. A device as defined in claim 5, wherein said pillow supported on the device contains a central opening sized slightly smaller than the patient's face to provide support means for the face, whereby cheek bones or other sturdy member of face is supported by edges of said opening in pillow.

7. A device as defined in claim 6, wherein said pillow includes pumping means enabling the pillow to be expanded with air by an air pumping system.

8. A device as defined in claim 7, wherein said pillow contains a pressure release valve, whereby air pressure is released from said pillow when pressure within the pillow reaches a maximum pressure allowance on said pressure release valve.

9. A device as defined in claim 8, wherein said pillow contains an interior wall attached between upper and lower walls of the pillow which forms an indentation across a top face of said pillow, said indentation forming a pocket to receive and support the patient's head.

10. A device as defined in claim 9, wherein said air pumping system includes an air pumping mechanism coupled to said pillow by an air-flow tube.

11. A device as defined in claim 10, wherein said baseplate includes a cleft opening and includes an air-flow tube inserted through said cleft opening from said pumping mechanism and placed into said pillow.

12. A device as defined in claim 1, wherein the attachment means consists of two rods coupled horizontally to the bottom side of said baseplate, said rods being insertable into holes in a side of the treatment table.

13. A device as defined in claim 12, wherein said two rods include adjustment means making the rods laterally adjustable to enable changes in separation distance between the rods when engaged at the table.

14. A device as defined in claim 1, wherein the attachment means comprises at least two clamps coupled to the bottom side of said baseplate, said clamps including means for clamping onto the treatment table.

15. A device as defined in 1, wherein the attachment means comprises a C-channel and channel insert respectively attached to joining ends of the support device and table.

16. A device as defined in claim 1, wherein said baseplate includes a strap of less than approximately 1 foot in length coupled between said baseplate and a second pillow.

17. A device as defined in claim 16, wherein said second pillow contains a groove indentation formed approximately midway across a top face of the pillow in a position adapted for contact with the patient's forehead.

18. A device as defined in claim 16, wherein said second pillow includes a medial hinged juncture enabling the pillow to be deformed into an arcuate path for sliding underneath the patient's head with minimal elevation of the head.

19. A method of positioning a second pillow under a patient's head and over a first pillow held in a head support device coupled to a treatment table, said method comprising the steps of:

a) suspending the second pillow from the head support device by a tether strap;

b) bending the pillow about a hinge point formed within an intermediate section of the second pillow to form an arcuate configuration within the pillow; and c) moving the pillow along a path conforming to the arcuate configuration to slide the pillow over an end of the head support device and under the patient's head.

* * * * *